US008910431B2

(12) United States Patent
Egan et al.

(10) Patent No.: US 8,910,431 B2
(45) Date of Patent: Dec. 16, 2014

(54) TOWER STRUCTURE

(71) Applicant: EMI Products, Inc., Houston, TX (US)

(72) Inventors: Fallon M. Egan, Katy, TX (US); Christoval Sanchez, Spring, TX (US); Patrick M. Weisbrod, Spring, TX (US)

(73) Assignee: EMI Products, LLC, Houston, TX (US)

( * ) Notice: Subject to any disclaimer, the term of this patent is extended or adjusted under 35 U.S.C. 154(b) by 0 days.

(21) Appl. No.: 14/063,809

(22) Filed: Oct. 25, 2013

(65) Prior Publication Data

US 2014/0115977 A1 May 1, 2014

Related U.S. Application Data

(60) Provisional application No. 61/719,225, filed on Oct. 26, 2012.

(51) Int. Cl.

| | |
|---|---|
| ***E04H 12/18*** | (2006.01) |
| ***E04H 12/34*** | (2006.01) |
| ***E02D 27/42*** | (2006.01) |
| ***E04H 12/00*** | (2006.01) |

(52) U.S. Cl.

CPC ..... *E04H 12/345* (2013.01); *E02D 27/42* (2013.01); *E04H 12/00* (2013.01); *E04H 12/347* (2013.01)

USPC ..... 52/116; 52/123.1

(58) Field of Classification Search

CPC .... E04H 12/187; E04H 12/345; H01Q 1/084; H01Q 1/1235; G09F 2017/0025

USPC ..... 52/32, 40, 116, 117, 120, 123.1, 52/745.17; 343/882, 890

See application file for complete search history.

(56) References Cited

U.S. PATENT DOCUMENTS

| | | | | | |
|---|---|---|---|---|---|
| 375,378 | A | * | 12/1887 | Perry | 52/40 |
| 1,102,413 | A | * | 7/1914 | Jensen | 116/173 |
| 1,438,166 | A | * | 12/1922 | Bolander | 116/173 |
| 2,822,066 | A | * | 2/1958 | Hanson | 52/117 |
| 2,875,865 | A | * | 3/1959 | Rohn | 52/116 |
| 2,985,261 | A | * | 5/1961 | Kubesh | 52/120 |
| 3,355,847 | A | * | 12/1967 | Pratt | 52/116 |
| 3,792,680 | A | * | 2/1974 | Allen | 116/173 |
| 3,941,083 | A | * | 3/1976 | Morse et al. | 116/173 |
| 4,020,606 | A | * | 5/1977 | Pratt | 52/116 |
| 4,114,375 | A | | 9/1978 | Saruwatari | |
| 4,149,347 | A | * | 4/1979 | Boemer | 52/116 |
| 4,151,534 | A | * | 4/1979 | Bond | 343/883 |
| 4,167,740 | A | * | 9/1979 | Shriver | 343/882 |
| 4,473,975 | A | * | 10/1984 | Golay | 52/29 |
| 4,590,718 | A | * | 5/1986 | Angeloff | 52/116 |
| 4,592,177 | A | * | 6/1986 | Pratt | 52/116 |
| 4,902,852 | A | * | 2/1990 | Wuertz | 174/493 |
| 5,058,336 | A | * | 10/1991 | Jenvey | 52/115 |
| 5,322,265 | A | | 6/1994 | Keuck | |

(Continued)

FOREIGN PATENT DOCUMENTS

| | | | |
|---|---|---|---|
| EP | 2 031 155 | A2 * | 11/2009 |
| GB | 2 349 653 | A * | 11/2000 |

*Primary Examiner* — Robert Canfield

(74) *Attorney, Agent, or Firm* — Patterson & Sheridan LLP

(57) ABSTRACT

Methods and apparatus for a tower structure and erection thereof include, in one embodiment, a tower structure comprising a base support member, a mast structure pivotally coupled to the base support member, and a motion control device coupled between the base support member and the mast structure for controlling movement therebetween.

18 Claims, 6 Drawing Sheets

(56) References Cited

U.S. PATENT DOCUMENTS

| | | | | | |
|---|---|---|---|---|---|
| 5,572,836 | A * | 11/1996 | Parker | 52/116 |
| 5,611,177 | A * | 3/1997 | Herbstritt | 52/111 |
| 5,782,042 | A * | 7/1998 | Klein | 52/116 |
| 5,899,651 | A * | 5/1999 | Jenvey | 414/23 |
| 6,782,667 | B2 | 8/2004 | Henderson | |
| 7,458,328 | B2 * | 12/2008 | Hall | 114/91 |
| 8,024,895 | B2 * | 9/2011 | Hall et al. | 52/123.1 |
| 8,130,168 | B1 * | 3/2012 | Sergi et al. | 343/882 |
| 2004/0221543 | A1 * | 11/2004 | Eleas et al. | 52/736.1 |
| 2012/0291368 | A1 * | 11/2012 | Anderson et al. | 52/117 |

* cited by examiner

TOWER STRUCTURE

CROSS-REFERENCE TO RELATED APPLICATION

This application claims priority to U.S. Provisional Patent Application Ser. No. 61/719,225, filed Oct. 26, 2012, which is hereby incorporated by reference herein.

BACKGROUND OF THE INVENTION

1. Field of the Invention

Embodiments of the invention generally relate to tower structure apparatus utilized for power generation, communications, lighting, among other uses, and methods of erecting and/or servicing tower structure apparatus.

2. Description of the Related Art

Tower structures utilized for supporting aerial components, such as lighting, antennas, solar modules and wind generators, are known. The tower structures generally include a pole and/or a truss structure that is coupled to the ground. The tower structures may support the aerial components a few feet above the ground to thousands of feet above the ground and are designed to withstand high winds.

Conventional tower structures above about 15 feet tall are typically installed using heavy equipment, such as a crane, and multiple workers. The installation of these tower structures is costly since heavy equipment must be purchased or rented and transferred to the erection site. Further, the installation procedure can take many days. Additionally, once the conventional tower structure is installed, aerial components coupled to the structure are not easily accessible for servicing, inspection or replacement without the use of heavy equipment or personnel lift apparatus.

Therefore, there is a need for a new tower structure that is less costly to install and provides easy access to any aerial components disposed thereon.

SUMMARY

Embodiments provided herein relate to tower structure apparatus utilized for power generation, communications, lighting, among other uses, and methods of erecting and/or servicing tower structure apparatus. In one embodiment, a tower structure is provided. The tower structure comprises a base support member, a mast structure pivotally coupled to the base support member, and a motion control device coupled between the base support member and the mast structure for controlling movement therebetween.

In another embodiment, a tower structure is provided. The tower structure includes a base support member, a mast structure coupled to the base support member at a pivot point, the mast structure having an extended member disposed on one side of the pivot point, a motion control device coupled between the base support member and the mast structure for controlling movement therebetween, and one or more weights disposed on the extended member.

In another embodiment, a method for erecting a tower structure is provided. The method includes fixing a foundation member to the ground, coupling a base support member to the foundation member, coupling a mast structure to the base support member at a pivot point, actuating a motion control device disposed between the base support member and the mast structure to rotate the mast structure relative to the base support member at the pivot point to raise the mast structure to an orientation wherein a longitudinal axis of the mast structure is substantially parallel to a longitudinal axis of the base support member, and securing the mast structure to the base support member.

BRIEF DESCRIPTION OF THE DRAWINGS

So that the manner in which the above recited features of the invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

Figure 1:
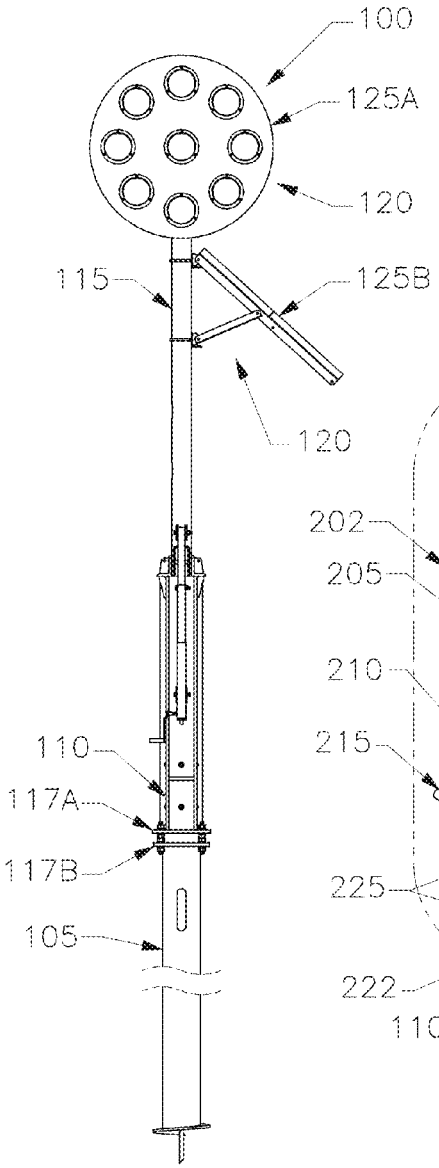
FIG. 1 is an elevation view of one embodiment of a tower structure.

To facilitate understanding, identical reference numerals have been used, wherever possible, to designate identical elements that are common to the figures. It is contemplated that elements and/or process steps of one embodiment may be beneficially incorporated in other embodiments without additional recitation.

DETAILED DESCRIPTION

Embodiments of the invention generally relate to a tower structure utilized to support aerial components, and methods of erecting and/or servicing the tower structure. The tower structures as described herein may include a fully erected height of between 10 feet to about 100 feet above the ground. The tower structures as described herein are modular units having discrete elements that may be easily transported and are configured to be erected on site without the use of a crane or heavy equipment. The tower structures may be constructed, installed and erected using minimal light-duty equipment and/or personnel. The elimination of cranes and minimization of heavy equipment saves costs of construction. Further, each of the tower structures as described herein may be partially deconstructed without the use of a crane or heavy machinery. This is particularly advantageous for maintenance of the tower structure and/or servicing or replacement of aerial components.

The aerial components as described herein may include antennae, power generation devices, power transmission devices, lighting devices, signal lights, communication devices, global positioning devices, satellite or microwave dishes, surveillance cameras, motion detectors, as well as flags, banners, signage, among other devices or articles adapted to be supported above the ground. Power generation devices include solar cells or solar arrays, wind generators, as well as other energy generators or energy collectors.

FIG. 1 is an elevation view of one embodiment of a tower structure 100 coupled a foundation member 105. The foundation member 105 is adapted to be coupled to a support base member 110 and a mast structure 115 is coupled to the support base member 110. The foundation member 105 is adapted to be stably coupled to the ground. The support base member 110 may include a base plate 117A that is fastened to a base plate 117B on the foundation member 105. The foundation member 105 may be a pier structure that is driven or otherwise installed into the ground, or the foundation member 105 may be a concrete foundation that is formed in the ground.

The mast structure 115 supports an aerial component 120, which is shown as a signal head 125A. Other types of aerial components 120 may be coupled to the mast structure 115 in lieu of or in addition to the signal head 125A. Additionally, aerial components 120 of differing or similar types and/or sizes may be coupled to the mast structure 115. For example, one or more aerial components 120, such as the signal head 125A and a solar panel 125B, may be coupled at different elevations along the length of the mast structure 115, as well as face different directions.

The tower structure 100 shown in FIG. 1 is configured to be erected on site without the use of crane. Further, the tower structure 100 may be constructed and erected using minimal heavy equipment and/or personnel. In one aspect, the tower structure 100 is adapted as a modular unit having multiple elements that are dimensioned to be handled manually by personnel during construction without the need for motorized lifting and/or handling equipment. In one example, the support base member 110 and the mast structure 115 are dimensioned to facilitate handling by two people.

Figure 2B:
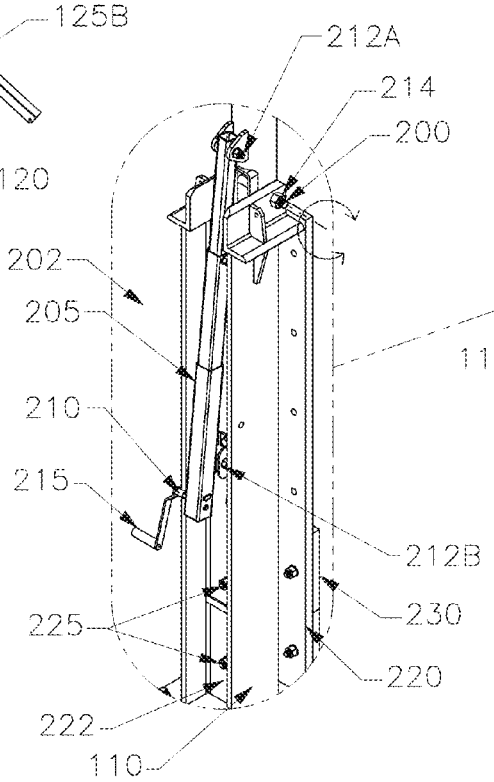
FIG. 2B is an exploded view of a portion of the tower structure of FIG. 2A.
Figure 2A:
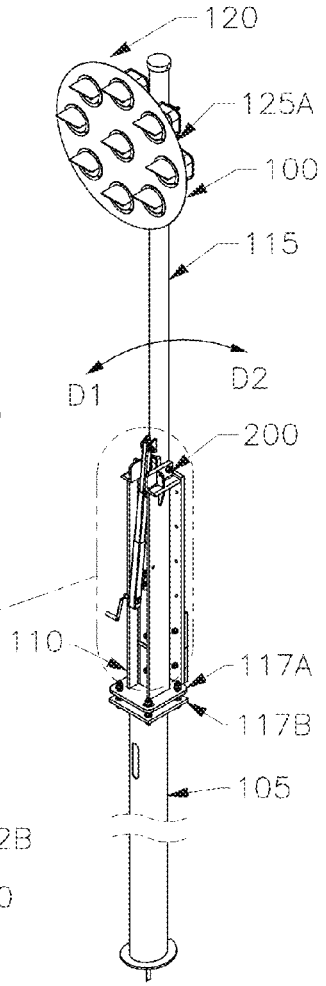
FIG. 2A is a side view of the tower structure of FIG. 1.

FIG. 2A is a side view of the tower structure 100 of FIG. 1. FIG. 2B is an exploded view of a portion of the tower structure 100 of FIG. 2A. The tower structure 100 includes a pivot point 200 located along a length thereof to facilitate movement of the mast structure 115 relative to the support base member 110 in the direction of the arrow. The mast structure 115 as shown in FIG. 2A is in a full upright position but may be moved in the direction D1 in a cantilever fashion when necessary. Movement of the mast structure 115 in the direction D1 is controlled by a motion control device 202 shown as a lift jack 205 in FIG. 2B. The lift jack 205 may be a screw-type jack device having a crankshaft 210 that interfaces with a rotation tool 215. The lift jack 205 may be coupled to the mast 115 at a first hinge point 212A and a second hinge point 212B located between the crankshaft 210 and the support base member 110. Each of the first hinge point 212A and the second hinge point 212B may be a pin or a bolt coupled to brackets that are fixed to the crankshaft 210 and the support base member 110, respectively. The pivot point 200 comprises fastener 214, such as a pin or bolt, which allows the mast structure 115 to pivot relative to the support base member 110.

The crankshaft 210 may be located on the tower structure 100 at a position that is accessible to personnel without the need for a ladder or other support equipment. The rotation tool 215 may be a removable or folding handle, a ratcheting tool, a drill motor, or other device that imparts torque on the crankshaft 210. Rotation of the crankshaft 210 causes the length of the lift jack 205 to change in order to facilitate and/or control movement of the mast structure 115 in the direction D1 (a lowering direction) and the direction D2 (a lifting direction). However, the motion control device 202 may be a hydraulic or pneumatic ram, as well as an electrically powered motion controller that extends and retracts to facilitate and/or control movement of the mast structure 115 in the direction D1 and the direction D2.

The mast structure 115 also includes an extended section 220 that at least partially overlays the support base member 110 when the mast structure 115 is in the upright position. The extended section 220 may function as a stop for movement of the mast structure 115 in the direction D2 by contacting a surface of the support base member 110. Fasteners 225 may be used to couple the extended section of the mast structure 115 to the support base member 110 in order to secure the mast structure 115. Additionally, the support base member 110 may include a recessed area 222 having an opening formed therethrough for receiving a hasp (not shown) that is fixed to a surface of the extended section 220 of the mast structure 115. The recessed area 222 may be a depression formed in the surface of the support base member 110 or a web of the support base member 110. The hasp may be a loop or bail that receives a shank of a padlock (not shown) to secure the mast structure 115 in the upright position.

The extended section 220 may also be appropriately weighted by weighting members 230 to facilitate a counterbalance effect when the mast structure 115 is moved in the directions D1 and D2. The weighting may be determined based on the size, number and/or position of the aerial components 120 on the mast structure 115. The weighting is provided to enable a positive control of the movement in both of the directions D1 and D2. One or a combination of the placement of the pivot point 200 and the weighting members 230 may be provided so the mast structure 115 continually exerts a slight positive force in the direction D1 even when the mast structure 115 is fully upright. This prevents a breakpoint during movement of the mast structure 115 where push-pull forces may be experienced and enables lifting of the mast structure 115 in a controlled manner. The weighting members 230 may be used to lessen the force on the lift jack 205 when moving. In one embodiment, the extended section 220 includes one or more weighting members 230 that may be added or removed based on the mass needed to create the appropriate counterbalance of the mast structure 115.

Figure 3:
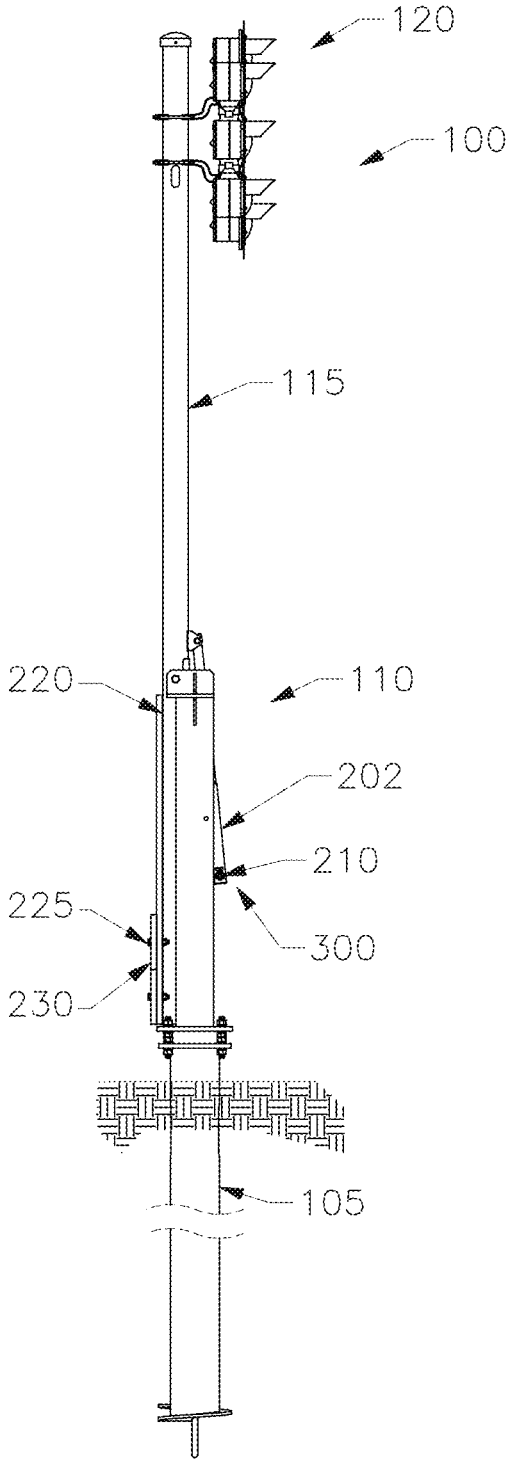
FIG. 3 is a side view of the tower structure of FIG. 1.

FIG. 3 is a side view of the tower structure 100 of FIG. 1. The tower structure 100 is shown in a fully erected position with fasteners 225 coupling the mast structure 115 to the support base member 110. A tool interface 300 is shown on a lower portion of the crankshaft 210. The tool interface 300 may be a socket or shaft that interfaces with a rotation tool 215 (shown in FIG. 2B). In one embodiment, the tool interface 300 is located about 3 feet, or less, from the surface of the ground, to about 5 feet above the surface of the ground, in order to facilitate access thereof by personnel without the need of a ladder.

Figure 4A:
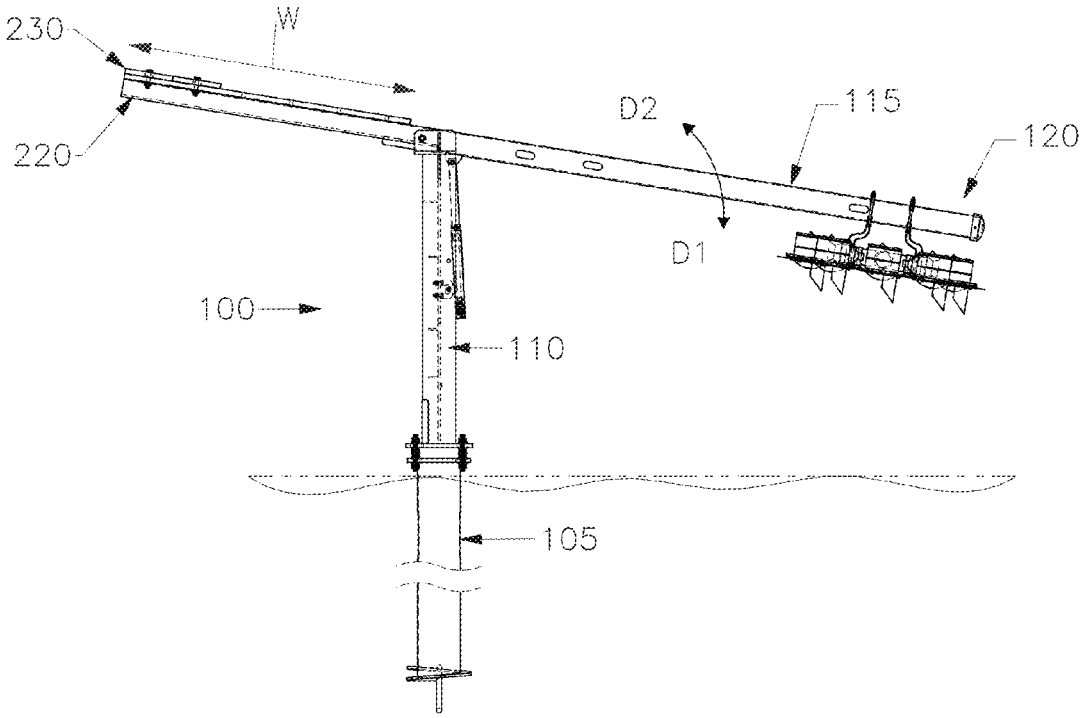
FIG. 4A is a side view of the tower structure of FIG. 3 in a tilted position for installation, maintenance, replacement procedures.

FIG. 4A is a side view of the tower structure 100 of FIG. 3 in a tilted position for installation, maintenance, replacement procedures of the aerial component 120. The mast structure 115 may be cantilevered relative to the support base member 110 to bring the end of the mast structure 115 a suitable working height from the ground. The working height and/or tilt angle may be dependent on the height of the support base member 110 and/or the length of the mast structure 115. In one embodiment, the tilt angle is about 100 degrees, but may be greater than or less than 100 degrees. In this position, personnel may install, check, repair or reposition the aerial component 120 without the need for ladders or other support equipment. Additionally, the mast structure 115 may be tilted slightly in the direction D2 (e.g., tilt angle of about 80 degrees to about 70 degrees, or less), in order to bring the extended section into a desired working height or position to adjust the weighting on the extended section 220. The adjustment may be determined based on the weight, position and or number of aerial components 120 on the mast structure 115. The adjustment may include adding or removing weights as well as moving the weights relative to the extended section 220 in the direction labeled W.

Figure 4B:
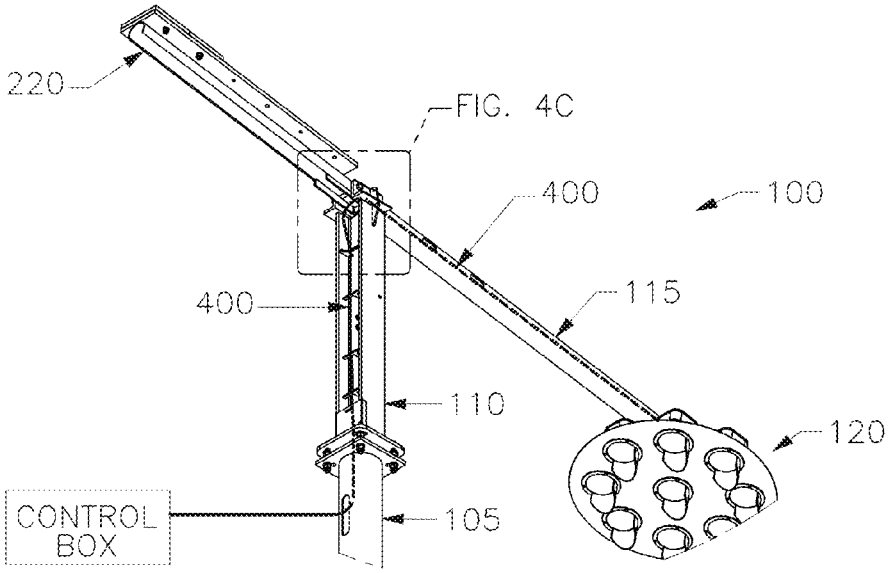
FIG. 4B is an isometric bottom view of the tower structure of FIG. 4A.

FIG. 4B is an isometric bottom view of the tower structure 100 of FIG. 4A. A continuous signal cable 400 is shown partially in dashed lines as a portion of the continuous signal cable 400 is contained within the mast structure 115 and, optionally, within the support base member 110. The continuous signal cable 400 is thus protected from UV rays and/or weather while also minimizing vandalism. The routing of the signal cable 400 directly from the aerial component 120 to a control box in a continuous, uninterrupted manner also minimizes signal loss, which occur at connections (plugs, junction boxes, or other coupling devices).

Figure 4C:
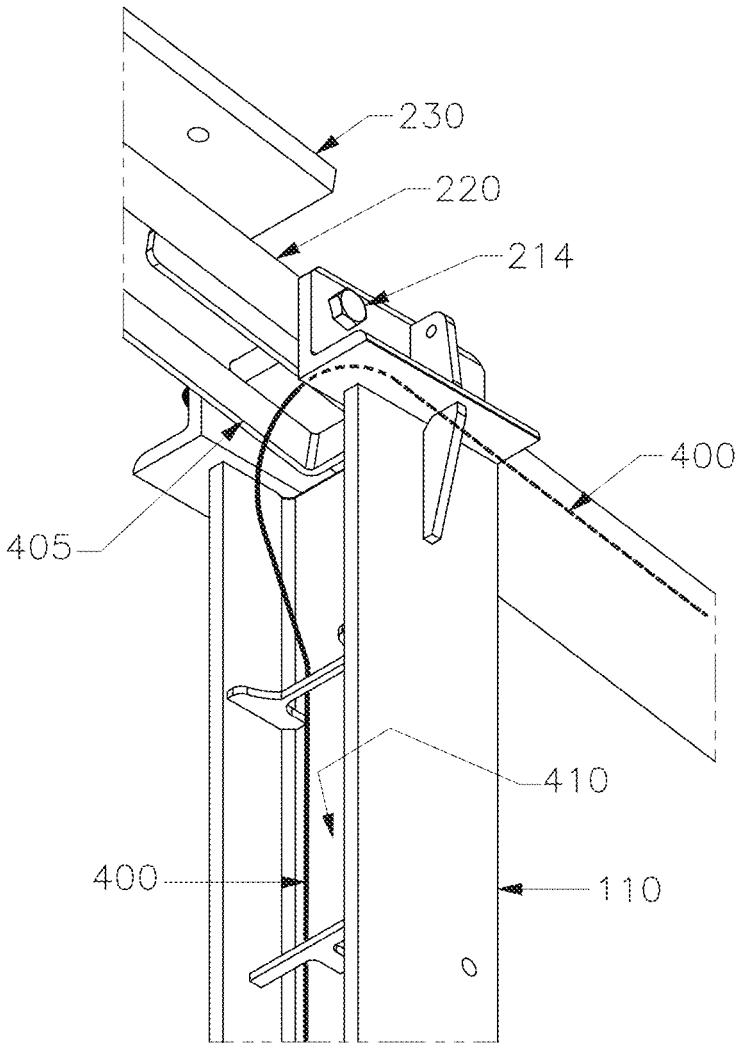
FIG. 4C is an enlarged view of a portion of the tower structure shown in FIG. 4B.

FIG. 4C is an enlarged view of a portion of the tower structure 100 shown in FIG. 4B. An opening 405 is shown in the mast structure 115 where the continuous signal cable 400 exits the mast structure 115. The continuous signal cable 400 may be coupled to and routed external to the support base member 110 in a recess 410. The continuous signal cable 400 may be protected from UV rays, weather and vandalism by the extended section when the mast structure 115 is in the upright position and is at least partially received in the recess 410.

Figure 5:
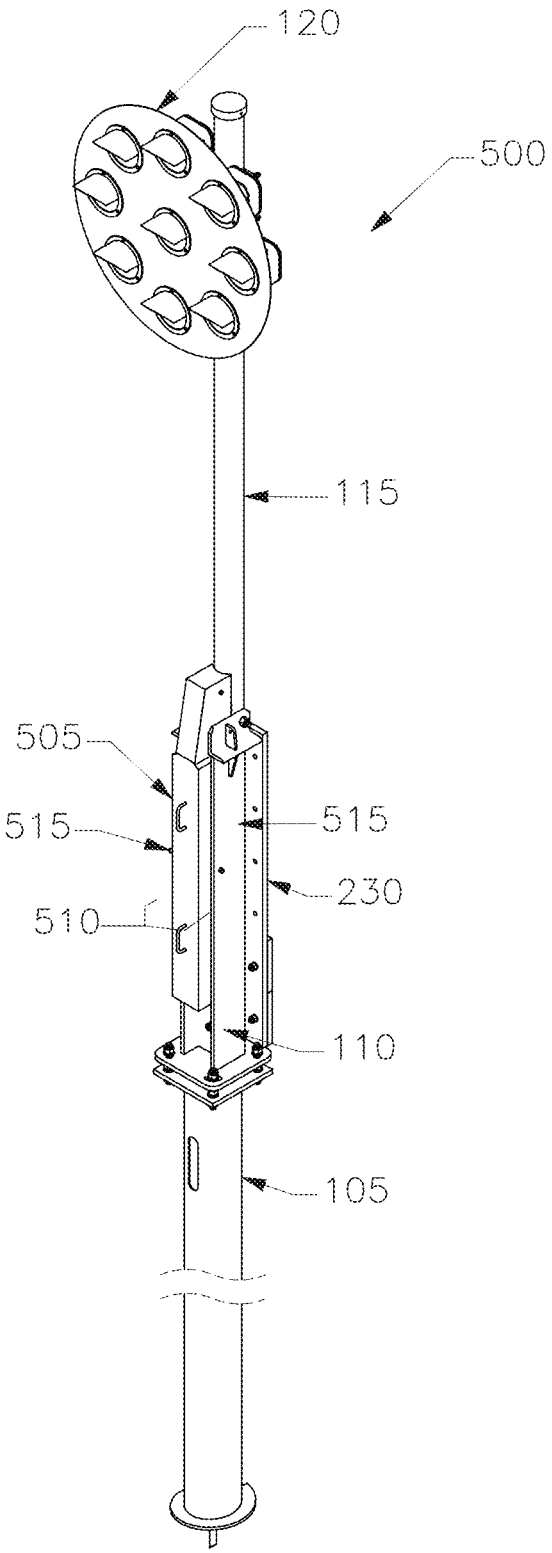
FIG. 5 is an isometric view of another embodiment of a tower structure.
Figure 6:
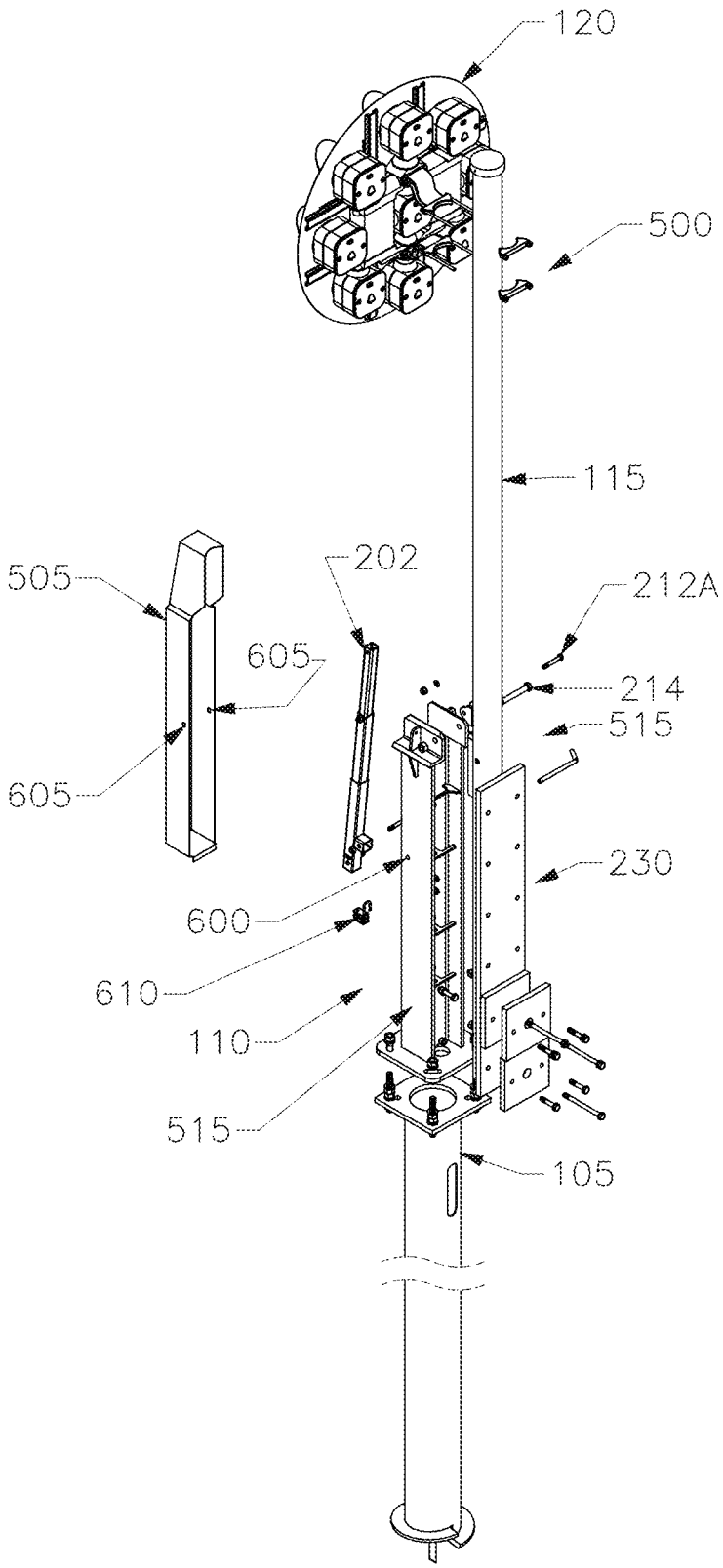
FIG. 6 is an exploded isometric view of the tower structure of FIG. 5.

FIG. 5 is an isometric view of another embodiment of a tower structure 500. FIG. 6 is an exploded isometric view of the tower structure 500 of FIG. 5. A cover 505 is shown coupled to the support base member 110 and a portion of the mast structure 115. The cover 505 may be secured by a locking device 510. The locking device 510 may comprise a pin 515 that is disposed through openings 600 (only one shown in the view of FIG. 6) formed in sides 515 of the support base member 110 (only one is shown in the view of FIGS. 5 and 6). Openings 605 formed in the cover 505 align with the openings 600 in the in the support base member 110 to receive the pin 515. A padlock 610 may be disposed in a transverse through hole (not shown) of the pin 515 to prevent removal of the cover. The locking device 510 may be disposed at a location on the tower structure 500 that enables easy access to personnel from the ground without the need for a ladder or other support equipment.

While the foregoing is directed to embodiments of the invention, other and further embodiments of the invention may be devised without departing from the basic scope thereof, and the scope thereof is determined by the claims that follow.

The invention claimed is:

1. A tower structure, comprising:
a base support member;
a mast structure pivotally coupled to the base support member;
a motion control device coupled between the base support member and the mast structure for controlling movement therebetween;
a weighting member to adjust a force acting on the mast structure; and
a cover disposable about the motion control device when the mast structure is in an upright position.

2. The tower structure of claim 1, wherein the motion control device comprises a jack.

3. The tower structure of claim 2, wherein the jack is a screw jack.

4. The tower structure of claim 2, wherein the jack is a hydraulic jack.

5. The tower structure of claim 1, further comprising:
an aerial component coupled to the mast structure.

6. The tower structure of claim 5, further comprising:
a continuous signal cable coupled to the aerial component.

7. The tower structure of claim 6, wherein the continuous signal cable is disposed in an interior of the mast structure.

8. The tower structure of claim 6, wherein the continuous signal cable is disposed in a recessed portion of the base support member.

9. The tower structure of claim 1, further comprising:
a cover coupled to the base support member to secure the motion control device.

10. A tower structure, comprising:
a base support member;
a mast structure coupled to the base support member at a pivot point, the mast structure having an extended member disposed on one side of the pivot point;
a motion control device coupled between the base support member and the mast structure for controlling movement therebetween;
one or more weights disposed on the extended member; and
a cover disposable about the motion control device when the mast structure is in an upright position.

11. The tower structure of claim 10, further comprising:
an aerial component coupled to the mast structure.

12. The tower structure of claim 10, further comprising:
a continuous signal cable coupled to the aerial component.

13. The tower structure of claim 12, wherein the continuous signal cable is disposed in an interior of the mast structure.

14. The tower structure of claim 12, wherein the continuous signal cable is disposed in a recessed portion of the base support member.

15. The tower structure of claim 10, further comprising:
a tool interface for controlling operation of the motion control device.

16. The tower structure of claim 15, wherein the tool interface is positioned about three feet to about five feet from the ground.

17. A method for erecting a tower structure, the method comprising:
fixing a foundation member to the ground;
coupling a base support member to the foundation member;
coupling a mast structure to the base support member at a pivot point;
actuating a motion control device disposed between the base support member and the mast structure to rotate the mast structure relative to the base support member at the pivot point to raise the mast structure to an orientation wherein a longitudinal axis of the mast structure is substantially parallel to a longitudinal axis of the base support member; and
securing the mast structure to the base support member, wherein securing the mast structure to the base support member comprises attaching a lock to a cover that is disposed about the motion control device.

18. The method of claim 17, wherein the actuating the motion control device comprises rotating a crankshaft of the motion control device.

* * * * *

UNITED STATES PATENT AND TRADEMARK OFFICE

CERTIFICATE OF CORRECTION

PATENT NO. : 8,910,431 B2
APPLICATION NO. : 14/063809
DATED : December 16, 2014
INVENTOR(S) : Egan et al.

It is certified that error appears in the above-identified patent and that said Letters Patent is hereby corrected as shown below:

On the Title Page, (71)

Delete "EMI Products, Inc." and insert -- EMI Products, LLC -- therefor.

Signed and Sealed this
Ninth Day of June, 2015

Michelle K. Lee

Michelle K. Lee
*Director of the United States Patent and Trademark Office*